United States Patent [19]

Elkins et al.

[11] 4,001,979

[45] Jan. 11, 1977

[54] UNLOADING RAMP ASSEMBLY

[75] Inventors: Raymon Kelsick Elkins, Arlington; Richard Neil Hutson, Dallas, both of Tex.

[73] Assignee: The Hutson Corporation, Arlington, Tex.

[22] Filed: Sept. 8, 1975

[21] Appl. No.: 611,129

[52] U.S. Cl. ..... 51/163.2; 209/247; 209/492

[51] Int. Cl.[2] ..... B24B 31/06

[58] Field of Search ..... 51/163 V, 163 R; 209/44, 243, 247, 235, 490, 492

[56] References Cited

UNITED STATES PATENTS

| | | | |
|---|---|---|---|
| 3,514,907 | 6/1970 | Strom | 51/163 V |
| 3,553,900 | 1/1971 | McKibben | 51/163 V |
| 3,633,321 | 1/1972 | Rise | 51/163 V |
| 3,694,968 | 10/1972 | Isaacson et al. | 51/163 R |
| 3,844,071 | 10/1974 | Barlett et al. | 51/163 V |
| 3,897,658 | 8/1975 | Kobayashi | 51/163 V |

FOREIGN PATENTS OR APPLICATIONS

| | | | |
|---|---|---|---|
| 16,519 | 7/1969 | Japan | 51/163 V |
| 1,224,050 | 3/1971 | United Kingdom | 51/163 V |

*Primary Examiner*—Frank W. Lutter
*Assistant Examiner*—Ralph J. Hill
*Attorney, Agent, or Firm*—Richards, Harris and Medlock

[57] ABSTRACT

An unloading ramp assembly for a vibratory finishing machine of the type having a toroidal bowl or hopper includes an input platform extending to a media separation assembly which in turn extends to an output platform leading out of the vibratory finishing machine. A rod extends across and above the hopper adjacent to the input platform, and a ramp is pivotally engagable with the rod and is adapted to extend downwardly therefrom into engagement with the bottom of the hopper. The insertion sequence for the ramp is initiated by engaging the upper end of the ramp with the rod across the entire width thereof and then engaging the lower end of the ramp with the moving media and piece parts in the hopper, whereby the lower end of the ramp is pivoted downwardly into engagement with the bottom of the hopper. The withdrawal sequence for the ramp is initiated by pivoting one side of the ramp out of engagement with the rod, whereby the moving media in the hopper pivots the ramp out of the hopper. In one embodiment of the invention the ramp is manually positioned, and in another embodiment a fluid powered cylinder is utilized to position the ramp relative to the rod.

30 Claims, 8 Drawing Figures

UNLOADING RAMP ASSEMBLY

BACKGROUND AND SUMMARY OF THE INVENTION

This invention relates to an unloading ramp assembly, and more particularly to an unloading ramp assembly for vibratory finishing machines of the toroidal bowl variety.

One type of vibratory finishing machine which has gained relatively widespread commercial acceptance incorporates a toroidal bowl or hopper which is annular in shape and U-shaped in cross section. In the use of such a vibratory finishing machine, a suitable media and piece parts to be finished are introduced into the hopper, together with a liquid such as water and in some instances a finishing agent. Vibratory apparatus is then utilized to effect vibration of the hopper and the contents thereof, whereby the piece parts are finished. Simultaneously the contents of the hopper are caused to follow a circular path around the annular interior of the hopper.

Apparatus for effecting unloading of the toroidal bowl type of vibratory finishing machine has been provided herebefore. However, the presently available apparatus generally comprises relatively complicated parts, and is therefore expensive to manufacture and use. Another disadvantage involves the fact that presently available unloading apparatus is sometimes difficult to use, and typically involves periodic maintenance. It is therefore apparent that a need exists for a substantial improvement in the art.

The present invention comprises an unloading ramp assembly which overcomes the foregoing and other disadvantages which have long since characterized the prior art. In accordance with the broader aspects of the invention, a rod extends above and across the U-shaped cross section of the hopper of a vibratory finishing machine, and defines a generally horizontally disposed axis. A ramp is adapted for engagement with the rod, whereby the ramp is supported for pivotal movement about the axis. The ramp extends from a lower end which engages the bottom of the hopper to an upper end positioned adjacent an input platform. The input platform extends to a media separation assembly which includes an apertured plate adapted to allow the media to pass therethrough and to return to the hopper under the action of gravity while supporting the piece parts and preventing the piece parts from returning to the hopper. The apertured plate in turn extends to an output platform which directs the piece parts out of the vibratory finishing machine.

In accordance with other aspects of the invention, the insertion sequence for the ramp is initiated by engaging the upper end of the ramp with the rod across the full width of the ramp. The lower end of the ramp is then allowed to come into engagement with the moving media and piece parts in the hopper of the vibratory finishing machine. This causes the ramp to be pivoted downwardly until the lower end thereof engages the bottom of the hopper. The withdrawal sequence for the ramp is initiated by pivoting one side of the ramp out of engagement with the rod. The moving media in the hopper of the vibratory finishing machine then causes the ramp to pivot upwardly and outwardly, whereby the ramp is discharged from the hopper of the vibratory finishing machine.

The media separation assembly is preferably removable so that the unloading ramp assembly may be fitted with a media separation assembly which is configured for a particular combination of media and piece part sizes. Side walls extend upwardly adjacent the input platform, and side walls extend upwardly adjacent the apertured plate of the media separation assembly to prevent media and/or piece part spillage. A side wall may extend forwardly from the input platform around the exterior of the hopper of the vibratory finishing machine, also to prevent media and piece part spillage.

In accordance with a first embodiment of the invention, the ramp is manually positioned both to initiate the insertion sequence and to initiate the withdrawal sequence. In accordance with a second embodiment of the invention, a fluid powered cylinder is utilized to position the ramp in order to initiate the insertion sequence and to position the ramp in order to initiate the withdrawal sequence. The operation of the fluid powered cylinder may be either semiautomatic or fully automatic in nature, with fully automatic operation being characterized by actuation of the fluid powered cylinder in accordance with a predetermined time sequence.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
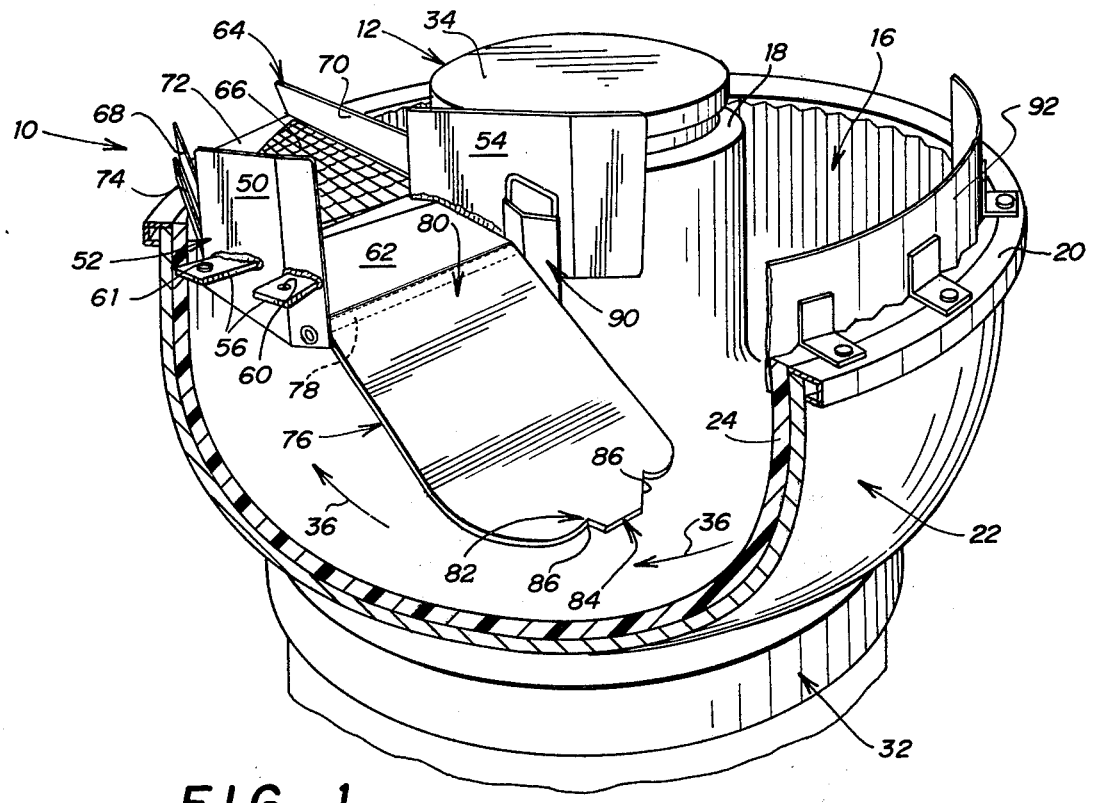
FIG. 1 is a perspective view of an unloading ramp assembly incorporating the invention.

Referring now to the Drawings, and particularly to FIG. 1 thereof, there is shown an unloading ramp assembly 10 incorporating the invention. The unloading ramp assembly 10 is utilized in conjunction with a vibratory finishing machine 12 of the type including a toroidal bowl 16. The toroidal bowl 16 may also be considered as comprising an annular hopper having a generally U-shaped cross section. The bowl or hopper 16 has an inner upper circular rim 18 and an outer upper circular rim 20 each extending around the entire circumference of the hopper 16.

The vibratory finishing machine 12 illustrated in FIG. 1 utilizes a hopper 16 comprising an outer bowl or tub 22. The tub 22 is typically formed from a suitable metal, such as steel, and is mounted on suitable springs (not shown) so as to permit the vibration of the hopper 16 and the contents thereof. A liner 24 may extend over the interior of the tub 22. The liner 24 preferably comprises a tough, resilient material, such as urethane. It will be understood that the present invention is not limited to tubs having the particular construction illustrated in FIG. 1, but may be employed in conjunction with vibratory finishing machines incorporating any of the conventional tub constructions.

The vibratory finishing machine 12 further includes a base 32 including a column 34 extending within the inner rim 18 of the hopper 16. The column 34 contains apparatus for effecting vibration of the hopper 16 and the contents thereof. For example, the column 34 may include a rotatably supported eccentric weight and structure for effecting rotation of the eccentric weight. This causes vibration which is transmitted to the hopper 16 by means of suitable bearings, brackets, etc. Such apparatus for effecting vibration of the hopper 16 and its contents is well known in the art, and does not comprise a part of the present invention.

In the use of the vibratory finishing machine 12, the hopper 16 receives piece parts to be finished and media which may comprise metal, glass, ceramic, plastic, wooden, or composite materials. The media may take the shape of balls, cones, discs, cylinders, triangles, stars, pyramids, polyforms, or random shapes. The hopper also receives a liquid such as water and may receive a finishing agent.

When the vibrating apparatus of the vibratory finishing machine 12 is actuated, the hopper 16 and the contents thereof are caused to vibrate at a preselected frequency and amplitude. This vibration causes the contents of the hopper to have a rolling or tumbling motion which is generally circular relative to the U-shaped cross section of the hopper 16. Also, the contents of the hopper follow a circular pattern relative to the annular configuration of the hopper 16. This motion of the hopper contents is indicated in FIG. 1 by the arrows 36.

The unloading ramp assembly 10 includes a frame 50. The frame 50 includes a pair of substantially vertically disposed plates 52 and 54 which also serve as guides. A pair of tabs 56 project outwardly from the plate 52 for engagement with the upper outer circular rim 20 of the hopper 16. A similar tab 58 (not shown in FIG. 1) extends inwardly from the plate 54 for engagement with the upper inner circular ring 18. The tabs 56 and 58 are provided with apertures 60 which receive suitable threaded fasteners 61 and thereby secure the frame 50 to the rims 18 and 20.

The frame 50 further includes a plate 62 extending between the plates 52 and 54 and secured thereto by suitable means, such as welding. Alternatively, the plates 52, 54 and 62 may comprise a unitary structure. The plate 62 defines an input platform which extends generally horizontally above and across the U-shaped cross section of the annular hopper 16.

A media separation assembly 64 extends rearwardly from the input platform 62. The assembly 64 includes an apertured plate 66 which may comprise screening, grating, or the like. Alternatively, the apertured plate 66 may comprise a plate of sheet metal having suitable apertures formed therein. The apertures of the plate are dimensioned to separate the piece parts from the media comprising the contents of the hopper. That is, the apertures are dimensioned to allow the media to pass therethrough and thereby return to the hopper 16 under the action of gravity. Simultaneously, the plate 66 supports the piece parts and prevents the piece parts from returning to the hopper 16. In this manner the plate 66 serves to separate the media from the piece parts and to return the media to the hopper while supporting the piece parts out of the hopper.

The media separation assembly 64 further comprises a pair of generally vertically disposed side walls 68 and 70 which serve as guides to constrain the media and parts to passing over the apertured plate 66. In this manner the plates 68 and 70 serve as continuations of the plates 52 and 54 with respect to the guiding function. Preferably the apertured plate 66 and the plates 68 and 70 comprise a subassembly in which it is detachably secured to the frame 50. This permits the aperture size of the plate 66 and the vertical height of the walls 68 and 70 to be selected in accordance with the requirements of a particular application of the unloading ramp assembly 10.

The media separation assembly 64 extends to an output platform 72. The platform 72 is secured to the frame 50 by means of rails 74 which support the media separation assembly 64. The output platform 72 extends over the outer rim 20 and serves to direct piece parts which have been separated from the media by the apertured plate 66 out of the vibratory finishing machine 12.

The unloading ramp assembly 10 further includes a ramp 76. A bar 78 is mounted on the frame 50 and extends between the plates 52 and 54. The bar 78 defines a generally horizontally disposed axis of pivotal movement for the ramp 76 which extends above and across the U-shaped cross section of the hopper 16. The bar 78 supports the upper end 80 of the ramp 76 in registry with the end of the input platform 62 remote from the media separation assembly 64. The lower end 82 of the ramp 76 engages the bottom of the hopper 16, as at 84. The lower end 82 of the ramp 76 may include notches 86 to permit liquids and media to pass under the ramp 76.

It will be understood that the angular relationship between the ramp 76 and the bottom of the hopper 16 depends on the vertical positioning of the bar 78 relative to the bottom of the hopper and the length of the ramp 76 from the upper end 80 to the lower end 82. In the actual practice of the invention it has been found that this angular relationship is not critical. Thus, the ramp 76 may extend at virtually any desired angle relative to the bottom of the hopper 16, from a very shallow angle wherein the ramp 76 extends a substantial distance around the interior of the hopper 16 to a very steep angle wherein the ramp 76 extends substantially vertically. In the latter instance it may be desirable to provide the interior of the hopper 16 with suitable stops to prevent the ramp 76 from pivoting under the bar 78.

Figure 4:
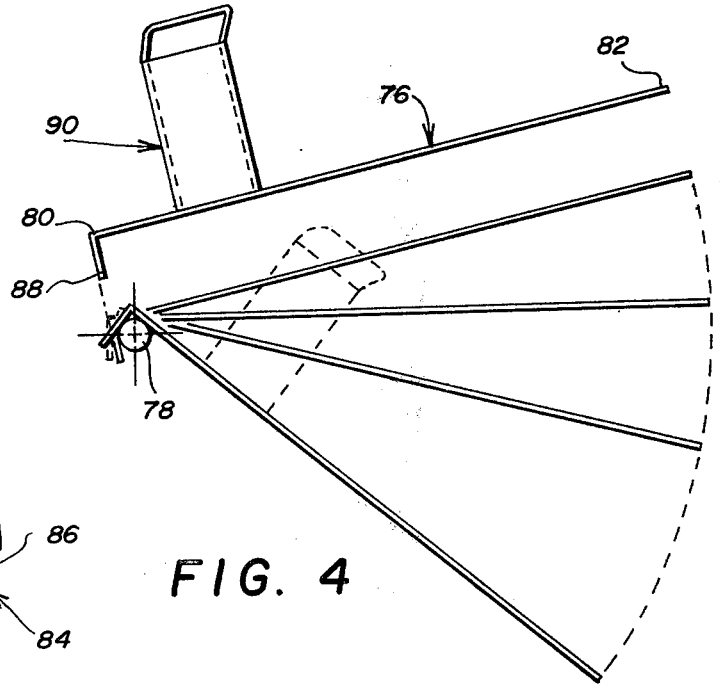
FIG. 4 is a sequential view illustrating the insertion sequence of the ramp of the unloading ramp assembly.

Referring to FIG. 4, the ramp 76 comprises a length of sheet metal such as steel which extends continuously from the upper end 80 to the lower end 82 of the ramp. This same length of sheet metal is bent downwardly adjacent the upper end 80 to provide a rod engaging flange 88. The inner surface of the flange 88 and the under surface of the main portion of the ramp 76 adjacent the upper end 80 cooperate to pivotally support the ramp 76 on the rod 78. The ramp 76 further includes a handle assembly 90 which extends upwardly from the main portion thereof on the side of the ramp 76 adjacent the inner rim 18 of the hopper 16 and the plate 54 of the unloading ramp assembly 10.

Figure 5:
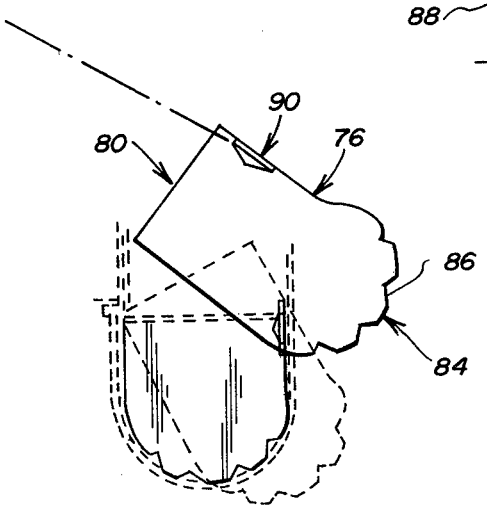
FIG. 5 is a sequential view illustrating the withdrawal sequence of the ramp.
Figure 2:
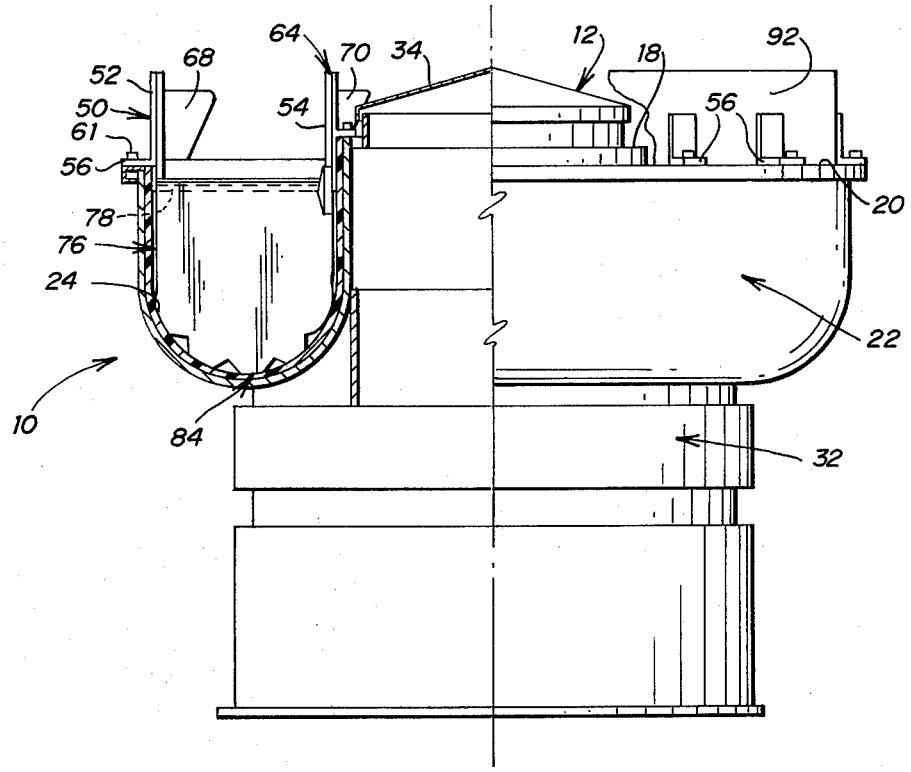
FIG. 2 is a sectional view further illustrating the unloading ramp assembly of FIG. 1.
Figure 3:
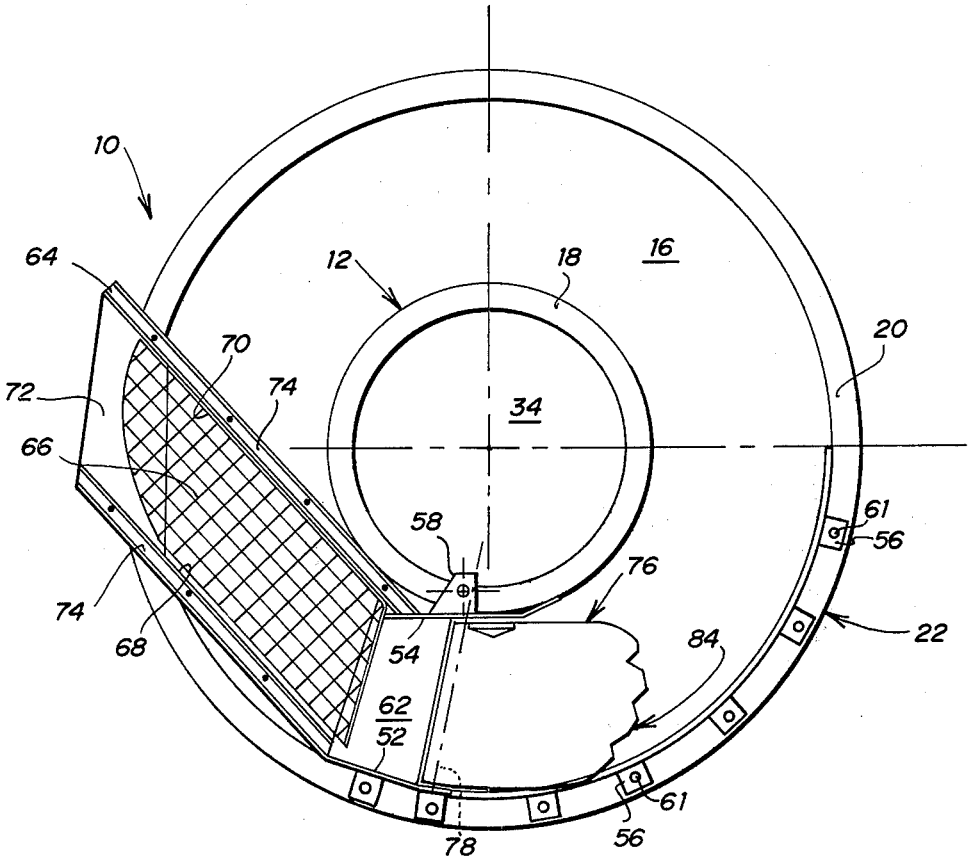
FIG. 3 is a top view further illustrating the unloading ramp assembly of FIG. 1.

The insertion sequence and the withdrawal sequence of the ramp 76 relative to the hopper 16 are illustrated in FIGS. 4 and 5, respectively, and comprise important aspects of the present invention. The ramp 76 is inserted into the hopper 16 by engaging the flange 88 and the upper end 80 of the ramp 76 with the rod 78. At this point the ramp 76 is engaged with the rod along the entire width thereof. The lower end 82 of the ramp 76 is then engaged with the upper surface of the moving media and piece parts within the hopper 16. Due to the fact that the media and piece parts are moving in the direction indicated by the arrows 36 in FIG. 1, the ramp 76 is caused to pivot downwardly until the lower end 82 thereof engages the bottom of the hopper 16. This sequence of pivotal movement is illustrated in FIG. 4.

Withdrawal of the ramp 76 from the hopper 16 is initiated by engaging the handle assembly 90 and pivoting the side of the ramp 76 situated adjacent the inner rim 18 upwardly and out of engagement with the rod 78. During this pivotal movement of the inner side of the ramp 76, the outer edge thereof remains engaged with the rod 78. This pivotal movement of the ramp 76 causes the ramp to extend angularly relative to the moving media within the hopper 16. Thereafter, due to the movement of the media in the direction indicated by the arrows 36 in FIG. 1, the media forces the ramp 76 upwardly and out of the hopper 16. This sequence of movement is illustrated in FIG. 5.

In the use of the vibratory finishing machine 12, the hopper 16 is initially filled with a suitable media, piece parts to be finished, a quantity of water, and in certain instances a finishing agent. The vibratory finishing machine 12 is then actuated to effect vibration of the hopper 16 and the contents thereof. As a result of this vibratory action, the piece parts within the hopper 16 are finished in the desired manner.

At the conclusion of the finishing operation it is necessary to unload the piece parts from the hopper 16. This is accomplished utilizing the unloading ramp assembly 10 of the present invention. First, a media separation assembly 64 having an apertured plate 66 adapted to separate the media from the piece parts is mounted in the manner shown in FIG. 1. The ramp 76 is then inserted into the hopper 16.

The insertion of the ramp 76 is accomplished by engaging the flange 88 with the rod 78 along the entire width of the ramp 76. The lower end 82 of the ramp is then engaged with the moving media and piece parts within the hopper 16. This action causes the ramp 76 to pivot downwardly until the lower end 82 thereof engages the bottom of the hopper 16. At this point the ramp 76 is positioned as illustrated in FIG. 1.

With the ramp 76 thus positioned, the moving media and piece parts within the hopper 16 travel upwardly on the ramp 76 and onto the input platform 62. The travel of the media and piece parts continues across the input platform 62 and onto the apertured plates 66 of the media separation assembly 64. At this point the media falls through the apertures of the plate 76 and is returned to the hopper 16 under the action of gravity. However, the piece parts are supported on the apertured plate 66 and travel across the plate 66 and across the output platform 62 for discharge out of the vibratory finishing machine 12.

During the use of the unloading ramp assembly 10, media and piece parts tend to accumulate on the input platform 62 and on the plate 66 of the media separation assembly 64. Spillage of the media and piece parts due to such accumulations is prevented by the plates 52, 54, 68 and 70. Additionally, a plate 92 extends around the outer rim 20 of the hopper 16 from the plate 52 in a direction opposite to the direction of movement of the media and the piece parts in the hopper 16 as indicated by the arrows 36. The use of the plate 92 has been found to be highly useful in preventing spillage of media and piece parts out of the vibratory finishing machine 12.

Figure 8:
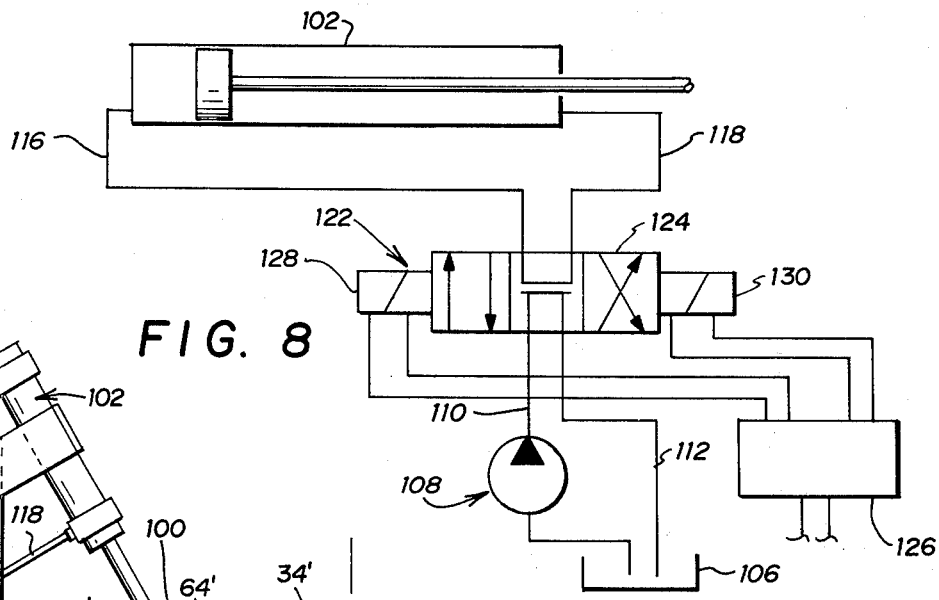
FIG. 8 is a schematic illustration of hydraulic circuitry which may be utilized in the embodiment of FIG. 6 in lieu of the circuitry of FIG. 7.
Figure 6:
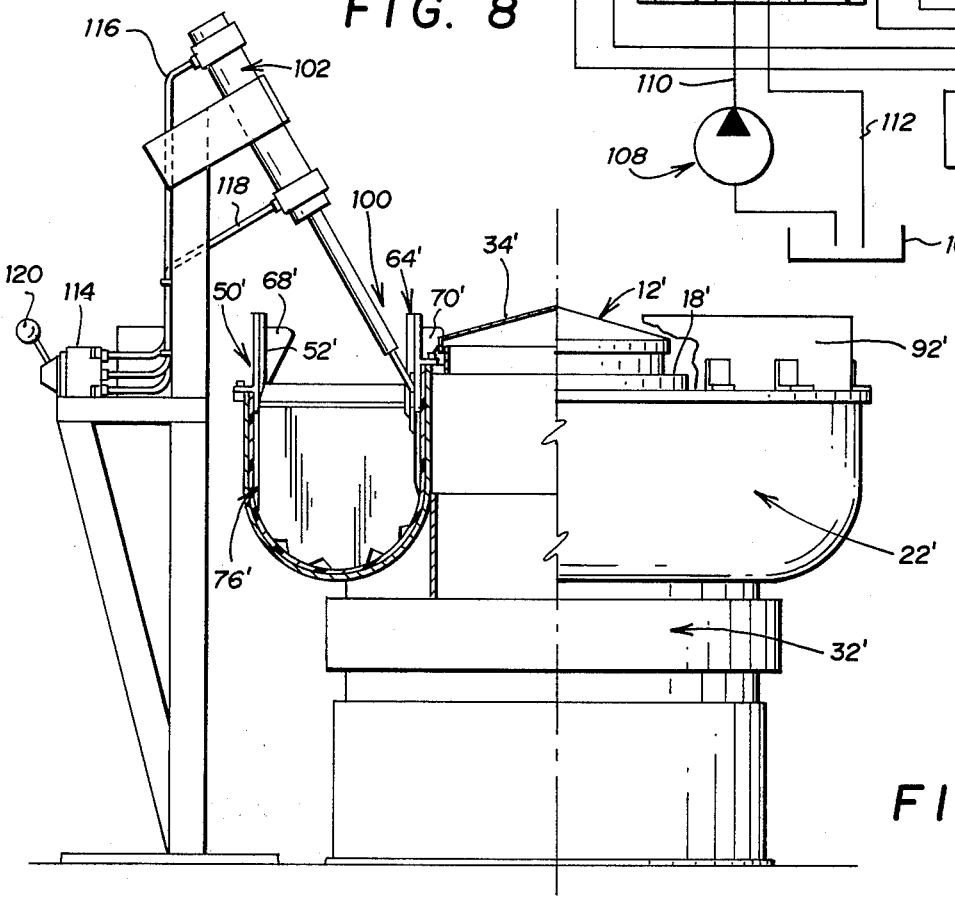
FIG. 6 is a view similar to FIG. 2 illustrating an alternative embodiment of the invention.
Figure 7:
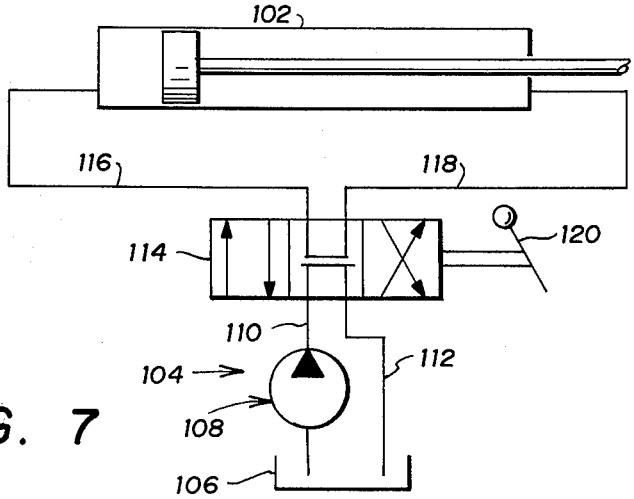
FIG. 7 is a schematic illustration of hydraulic circuitry utilized in conjunction with the embodiment of FIG. 6.

FIGS. 6, 7 and 8 illustrate an unloading ramp assembly 100 incorporating a second embodiment of the invention. The unloading ramp assembly 100 incorporates numerous component parts which are substantially identical in construction and function to component parts of the unloading ramp 10. Such identical component parts are designated in FIG. 6 with the same reference numerals utilized hereinbefore in the description of the component parts of the unloading ramp 10, but are differentiated therefrom by means of a prime (′) designation.

The primary differentiation between the unloading ramp assembly 100 and the unloading ramp assembly 10 involves the fact that the unloading ramp assembly 100 incorporates a fluid powered cylinder 102 to effect positioning of the ramp 76′. It will be readily understood by those in the art that the ramp 76′ could also be positioned by a pneumatic powered cylinder.

The cylinder 102 performs two functions in the operation of the unloading ramp assembly 100. Initially, the cylinder 102 positions the ramp 76′ with the flange 88′ thereof engaging the rod 78′ across the entire width of the ramp 76′. Thereafter the lower end 82′ of the ramp 76′ is pivoted downwardly into engagement with the bottom of the hopper 16′ in the same manner described hereinbefore in conjunction with FIG. 4.

Subsequently the fluid powered cylinder 102 is utilized to pivot one end of the ramp 76′ out of engagement with the rod 78′. At this point the ramp 76′ is moved out of the hopper 16′ under the action of the moving media therein. The withdrawal sequence of the ramp 76′ is the same as that described hereinbefore in connection with FIG. 5.

Referring to FIG. 7, the fluid powered cylinder 102 may comprise, for example, a hydraulic cylinder. A hydraulic circuit 104 including a reservoir 106 and a pump 108 are employed to supply pressurized hydraulic fluid to a line 110 and to receive spent hydraulic fluid through a line 112. A manually operable three position, four way valve 114 is utilized to control the flow of hydraulic fluid to and from a pair of lines 116 and 118 extending to the blind end and to the rod end of the fluid powered cylinder 102, respectively.

The valve 114 includes a handle 120 which is utilized to control the positioning of the valve spool. The handle is initially actuated to actuate the valve 114 to extend the cylinder 102 whereby the ramp 76′ is engaged with the rod 78′ across its full width. This initiates the insertion sequence as shown in FIG. 4, whereby the unloading operation of the unloading ramp assembly 100 is commenced. At the completion of the unloading operation the handle 120 is manipulated to actuate the cylinder 102 to disengage one end of the ramp 76′ from the rod 78′, whereby the withdrawal sequence as shown in FIG. 5 is commenced. In FIG. 8 there is shown a hydraulic circuit 122 which may be used in lieu of the circuit 104 of FIG. 7 to control the operation of the fluid powered cylinder 102. The circuit 122 is essentially the same as the circuit 104, but includes a solenoid operated valve 124 in lieu of the manually operable valve 114. A timer circuit 126 is utilized to effect operation of the valve 124 by means of a pair of solenoids 128 and 130. In this manner the operation of the unloading ramp assembly 100 is caused to follow a predetermined timed sequence of operation.

From the foregoing, it will be understood that the present invention comprises an unloading ramp assembly incorporating numerous advantages over the prior art. Perhaps the most important advantage deriving from the use of the invention involves the fact that unloading ramp assemblies constructed in accordance therewith are adapted to be manufactured from relatively uncomplicated parts, and are therefore economical to manufacture and use. Another important advantage deriving from the use of the invention involves the fact that unloading ramp assemblies constructed in accordance therewith are relatively simple to use and are substantially maintenance free. Other advantages deriving from the use of the invention will readily suggest themselves to those skilled in the art.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A vibratory finishing machine including:

an annular hopper having a generally U-shaped cross section and having inner and outer upper circular rims;

vibratory means for effecting vibration of the hopper and the contents thereof comprising at least media and parts and thereby causing movement of the contents around the hopper; and an unloading ramp assembly comprising:

input platform means including structure for engagement with the inner and outer upper rims of the hopper to support the input platform means extending generally horizontally above and across the U-shaped cross section of the annular hopper;

media separation means extending generally horizontally from the input platform means above the hopper and comprising a plurality of apertures of predetermined size whereby media falls through the apertures into the hopper while parts are supported by the separation means;

output platform means extending generally horizontally from the media separation means across the outer rim of the hopper for diverting parts out of the vibratory finishing machine;

ramp means for substantially filling the space between the side walls of the hopper and for substantially filling the space between the bottom wall of the hopper and the input platform means whereby media and parts moving in the hopper under the action of the vibratory means travel upwardly onto the ramp means, then onto the input platform means, then onto the media separation means, the media falling through the apertures in the media separation means and thereby returning to the hopper, and the parts travel across the media separation means and onto the output platform means;

means for supporting the ramp means for pivotal movement about a substantially horizontally disposed axis extending above and across the hopper adjacent to the end of the input platform means remote from the media separation means with the ramp means extending from the axis in a direction extending generally opposite to the direction of movement of the hopper contents so that when the ramp means is engaged with the upper surface of the moving contents of the hopper the ramp means is pivoted downwardly about the axis until the ramp means engages the bottom of the hopper; and means for disengaging the ramp means from the supporting means and for pivoting the ramp means into an orientation relative to the moving contents of the hopper whereby the moving contents function to eject the ramp means from the hopper.

2. The unloading ramp assembly according to claim 1 further characterized by generally vertically extending inner and outer guide means extending along the opposite sides of the input platform means, the media separation means and the output platform means.

3. The unloading ramp assembly according to claim 1 wherein the outer guide means further extend along the outer upper rim of the hopper from the input guide means in a direction opposite to the direction of movement of the contents of the hopper under the action of the vibratory apparatus.

4. The unloading ramp assembly according to claim 1 wherein the media separation means comprises screen means.

5. The unloading ramp assembly according to claim 1 wherein the ramp means is substantially imperforate to the movement of either media or parts through the hopper and thereby constrains the media and parts to movement upwardly on the ramp means and onto the input platform means, and wherein the ramp means includes at least one aperture to facilitate the flow of liquid therethrough.

6. The unloading ramp assembly according to claim 1 wherein the axis defining means comprises rod means extending continuously between points adjacent to the inner and outer upper rims.

7. The unloading ramp assembly according to claim 6 wherein the ramp means comprises a substantially planar member and wherein the means for cooperation with the axis defining means comprises a downwardly turned portion of the planar structure of the ramp means.

8. The unloading ramp according to claim 1 wherein the ramp disengaging means comprises handle means secured to the ramp means and normally positioned adjacent the inner upper rim of the hopper.

9. The unloading ramp assembly according to claim 1 wherein the ramp disengaging means comprises fluid powered cylinder means connected to the ramp means and means for selectively actuating the fluid powered cylinder means to alternately engage the ramp means with the axis defining means and to disengage the ramp means therefrom.

10. A vibratory finishing machine comprising:

an annular hopper having a U-shaped cross section extending to inner and outer horizontally disposed upper circular rims;

vibratory means for effecting vibration of the hopper and the contents thereof comprising at least media and parts to be finished and thereby causing the contents to travel around the hopper in a predetermined direction; and an unloading ramp assembly comprising:

frame means supported on the inner and outer upper rims and extending across and above the U-shaped configuration of the hopper;

ramp means dimensioned to substantially block the movement of the contents of the hopper with respect thereto under the action of the vibratory means;

cooperating means on the frame means and the ramp means for supporting the ramp means for pivotal movement about a horizontal axis extending above and across the hopper with the ramp means initially engaging the upper surface of the contents of the hopper and extending in a direction opposite to the direction of movement of the contents of the hopper under the action of the vibratory means so that the ramp means is pivoted downwardly into the hopper under the action of the moving contents thereof;

the ramp means thus defining a lower end extending substantially into the U-shaped cross section of the hopper and an upper end positioned above the hopper at a point substantially coincident with the axis of pivotal movement of the ramp means;

input platform means comprising a substantially horizontally disposed surface extending across and above the hopper and having an input end substantially coincident with the upper end of the ramp means and an output end;

media separation means positioned above the hopper for receiving media and parts from the input platform means and comprising a plurality of apertures dimensioned to separate the media from the parts by permitting the media to return to the hopper while supporting the parts and thus preventing the return thereof to the hopper;

output platform means for receiving parts from the media separation means and extending across the outer rim to direct the parts out of the vibratory finishing machine; and means for selectively pivoting the ramp means into an orientation wherein it extends substantially angularly relative to the horizontal axis of pivotal movement so that the motion of the contents of the hopper under the action of the vibratory means functions to lift the ramp means out of the hopper.

11. The unloading ramp assembly according to claim 10 wherein the U-shaped cross section of the annular hopper comprises a predetermined width and a predetermined depth, and wherein the ramp means has a width substantially equal to the predetermined width and a length at least as long as the predetermined depth.

12. The unloading ramp assembly according to claim 11 wherein the ramp means comprises a substantially planar member, and wherein the means supporting the ramp means for pivotal movement about a horizontal axis comprises a portion of the planar member of the ramp means extending substantially angularly relative to the major portion thereof.

13. The unloading ramp assembly according to claim 12 wherein the ramp means is substantially imperforate to the movement of parts and media around the hopper under the action of the vibratory apparatus, and wherein the ramp means further includes at least one aperture to permit the passage of liquids thereby.

14. The unloading ramp assembly according to claim 10 wherein the means for selectively pivoting the ramp means comprises handle means secured to the ramp means and positioned adjacent to the inner upper rim of the hopper when the ramp means is supported for pivotal movement about the horizontal axis.

15. The unloading ramp assembly according to claim 10 wherein the means for selectively pivoting the ramp means comprises fluid powered cylinder means for selective actuation to position the ramp means for pivotal movement about the horizontal axis and to position the ramp means in an orientation wherein it extends substantially angularly relative to the horizontal axis.

16. The unloading ramp assembly according to claim 15 further including timer means for regulating the operation of the fluid powered cylinder means and thereby positioning the ramp means in accordance with a predetermined time sequence.

17. The unloading ramp assembly according to claim 10 further characterized by inner and outer guide means extending along the opposite sides of the input platform means, the media separation means and the output platform means.

18. The unloading ramp assembly according to claim 17 wherein the outer guide means further extends along the outer rim of the hopper from the input guide means in a direction opposite to the direction of movement of the contents of the hopper under the action of the vibratory apparatus.

19. The unloading ramp assembly according to claim 10 wherein the media separation means comprises screen means extending between the input platform means and the output platform means.

20. An unloading ramp assembly comprising:

an elongate rod having a length substantially equal to the width of the hopper of a vibratory finishing machine;

means supporting the rod above the hopper of the vibratory finishing machine and extending substantially radially with respect thereto so that the rod defines a substantially horizontally disposed axis of pivotal movement;

ramp means including a substantially planar surface at least as long as the distance from the rod to the bottom of the hopper of the vibratory finishing machine;

means at the upper end of the ramp means for pivotally engaging the ramp means with the rod across the entire width of the ramp means and thereby initiating an insertion sequence in which the bottom end of the ramp means is engaged with moving media and piece parts in the hopper and the ramp means is thereby pivoted downwardly into engagement with the bottom of the hopper; and handle means secured to one side of the ramp means for disengaging said one side of the ramp means from the rod.

21. The unloading ramp assembly according to claim 20 further characterized by media separation means positioned to receive media and piece parts from the ramp means and comprising means for returning the media to the hopper of the vibratory finishing machine under the action of gravity while supporting the piece parts out of the hopper.

22. The unloading ramp assembly according to claim 21 wherein the media separation means is detachably supported above the hopper of the vibratory finishing machine.

23. The unloading ramp assembly according to claim 22 further including input platform means extending substantially horizontally from the upper end of the ramp means to the media separation means.

24. The unloading ramp assembly according to claim 23 further characterized by output platform means extending from the media separation means out of the vibratory finishing machine.

25. An unloading ramp assembly for use in a vibratory finishing machine having a generally toroidal shaped open hopper and containing at least finishing pieces and a media travelling together circumferentially around the hopper, comprising:

an elongate cylindrical supporting rod extending substantially the radial width of the annular opening of the hopper, means for rigidly positioning said rod within the upper portion of the hopper above the level of media and finishing pieces, an insertable ramp having a substantially planar surface with an upper end having means for pivotally engaging the longitudinal axis of said rod, said ramp extending substantially the radial width of the annular opening of the hopper and extending in a lengthwise direction to a lower end engaging the bottom of the hopper to thereby act as a dam to opposing the circumferential travel of the media and finishing pieces; and means for initiating insertion and withdrawal of said ramp by initially pivotally engaging said upper end of said ramp along the entire width of said rod to thereby cause said lower end of said ramp to move vertically downward through the media and finishing pieces and by subsequently pivotally engaging a first lengthwise edge of said upper end of said ramp upon an end of said rod to thereby cause said lower end of said ramp to be pushed upwards under the action of the media and finishing pieces travelling under said ramp.

26. The unloading ramp assembly according to claim 25 wherein said means for initiating insertion and withdrawal of said ramp comprises handle means secured to the lengthwise edge of said ramp opposite said first pivotally supported lengthwise edge of said ramp to thereby initiate the insertion and withdrawal of said ramp.

27. The unloading ramp assembly according to claim 25 wherein said means for initiating insertion and withdrawal of said ramp comprises a hydraulic powered rod secured to the lengthwise edge of said ramp opposite said first pivotally supported lengthwise edge of said ramp to thereby initiate the insertion and withdrawal of said ramp.

28. The unloading ramp assembly according to claim 25 wherein said means for initiating insertion and withdrawal of said ramp comprises a pneumatic powered rod secured to the lengthwise edge of said ramp opposite said first pivotally supported lengthwise edge of said ramp to thereby initiate the insertion and withdrawal of said ramp..

29. The unloading ramp assembly according to claim 25 further characterized by media separation means positioned to receive media and finishing parts from said ramp and including means for returning the media to the hopper under the action of gravity while supporting the finishing pieces out of the hopper.

30. The unloading ramp assembly according to claim 25 further characterized by output platform means for receiving finishing pieces from said media separation means.

* * * * *